United States Patent [19]

Marcus et al.

[11] 4,299,015

[45] Nov. 10, 1981

[54] PROCESS FOR SPACE DYEING AND TEXTURING SYNTHETIC YARNS

[76] Inventors: Frederick Marcus, 803 Briarwood Rd., Newtown Square, Pa. 19073; Richard Dikeman, R.D. #3, Box 850, Oxford, Pa. 19363; Allan A. Wiggins, Jr., 606 N. Brandywine St., West Chester, Pa. 19380

[21] Appl. No.: 59,640

[22] Filed: Jul. 23, 1979

[51] Int. Cl.[3] ..... D02G 1/12; D02G 1/20

[52] U.S. Cl. ..... 28/221; 28/258; 28/265; 8/483; 8/489

[58] Field of Search ..... 28/220, 221, 218, 258, 28/265; 8/478, 483, 489

[56] References Cited

U.S. PATENT DOCUMENTS

| | | | |
|---|---|---|---|
| 3,434,189 | 3/1969 | Buck et al. | 8/489 X |
| 3,780,516 | 12/1973 | Kimbrell | 28/246 |
| 3,946,468 | 3/1976 | Satterwhite | 28/220 |
| 3,986,235 | 10/1976 | Norris | 8/483 X |
| 4,087,242 | 5/1978 | Frank et al. | 8/478 |

FOREIGN PATENT DOCUMENTS

| | | | |
|---|---|---|---|
| 2332773 | 1/1974 | Fed. Rep. of Germany | 28/221 |

*Primary Examiner*—Robert Mackey
*Attorney, Agent, or Firm*—Mortenson & Uebler

[57] ABSTRACT

A process is provided for space dyeing synthetic yarn in which the synthetic yarn, such as polyester yarn, wound upon a yarn package, is first treated by immersing the ends of the package into a solution of at least one sublimatable ink, thereby dyeing the yarn located at the ends of the package but leaving the yarn at the center of the package undyed, and then at least two ends from at least two such packages are passed through otherwise conventional drawing and texturizing apparatus. Each yarn so fed is intermittently dyed and undyed along its length, the color strength near the dye boundaries being attenuated and muted due to sublimation of the inks and diffusion and migration of the dyes through the yarn ends and into the package. By utilizing at least two feed yarn packages in such process having significantly different diameters and different colored ends thereof, very highly random dyeing effects are achieved in a knitted or woven fabric produced from such yarns. Also provided are the new, space-dyed yarns produced by the aforesaid process and fabrics produced from such yarns.

5 Claims, 5 Drawing Figures

3Ply-3Color

4Ply-3Color

PROCESS FOR SPACE DYEING AND TEXTURING SYNTHETIC YARNS

BACKGROUND OF THE INVENTION

This invention concerns space-dyeing of synthetic yarns. The term "space-dyeing" refers to a dyeing process whereby dye is applied intermittently along the length of yarn such that, when the yarn is woven or knitted into a fabric, a more or less random color pattern is produced in the fabric.

In the past, there have been many attempts to provide space-dyed yarn by applying tints and dyes to one or both ends of a yarn package which, upon being woven or knitted into a fabric, yielded an intermittent color effect. These attempts to date have generally not provided dyed fabrics having commercially acceptable wet processing (wash fastness) characteristics.

U.S. Pat. No. 4,097,232 discloses a process for treating yarn packages with dyes followed by introducing heated steam for a time sufficient to cause the dyes to partially penetrate the yarn package. This process involves treating yarn in package from with one or more dyes or dye acceptance modifiers to modify or dye the yarn fibers in a reproducible manner to provide repeating contiguous sections of yarn having desired characteristics. In a preferred process, a dye acceptance modifier in the form of a resist is infused into one or both of the ends of a yarn package and a heated fluid (steam) is then introduced under pressure at a temperature and for a time sufficient to cause the resist to at least partially penetrate the package and contact individual strands of yarn or fibers, and to set the resist.

U.S. Pat. No. 3,986,235 discloses a process for producing space-dyed textile strands by a process of contacting each of the flat ends of a wound yarn package with a coloring agent, withdrawing the yarn from the yarn package, and rewinding the yarn in reverse order into a second yarn package having at least one substantially flat end, and then contacting each of the flat ends of the rewound yarn package with a color modifying agent, e.g. a dye. The colored yarn can then be withdrawn from the rewound yarn package and woven or tufted into a carpet, for example, and dyed, resulting in a carpet having random flecks of contrasting color therein.

Copending United States Patent Application Ser. No. 946,607, filed in the name of Allen A. Wiggins, Jr., discloses a process in which partially oriented synthetic yarn such as partially oriented polyester yarn is fed continuously first to and through a bath of a liquid conditioning agent such as a sublimatable dye, then to a first heated roll and then to a second heated draw roll to draw the partially oriented yarn, then to a texturizer and then to a takeup roll, all in one continuous operation, to produce a conditioned and texturized yarn product possessing about 12% to about 30% latent shrinkage. Also provided is a process for dyeing undrawn, partially drawn or fully drawn synthetic yarns using sublimatable inks. A method of space-dyeing using a gravure-type roll applicator is also disclosed therein.

The aforementioned references, either alone or in combination, do not disclose space dyeing of unoriented or partially oriented synthetic yarns, using a sublimatable ink dyeing agent, by a method of applying the sublimatable ink to at least one end of at least one yarn package and thereafter drawing and heating and texturizing the yarn to produce a space-dyed, textured yarn. Further, the references do not disclose a process for producing a highly random color pattern in a woven or knitted fabric by feeding, in a predetermined sequence, multiple ends of multicolored, space-dyed yarn packages produced by the process of this invention. Such process and the products produced thereby are the subject of the present invention.

By way of definition, the following terms are used herein. The term "undrawn yarn" is used to designate synthetic yarn having no orientation of its molecules or, at most, only a small degree of orientation, which yarn has been drawn prior to processing according to this invention to a degree considerably less than two (2) times its as-spun undrawn length.

The term "yarn package" means yarn wound upon a core by the yarn manufacturer, and rewinding upon a special dyeing package is unnecessary.

The term "sublimatable ink" as used herein refers to inks made primarily for printing applications. Insofar as is known, they consist of disperse dyes ground to a very fine particle size, and suspended in a water solution with the aid of suitable dispersing agents. They are generally intended for use where the ink is first applied to a printing paper and then transferred to a fabric being dyed by means of sublimation of the pigment and transferral to the fabric in the vapor phase. To satisfy various applications, these inks are available commercially in three general energy levels. Energy level indicates the degree of heat required to vaporize the dye-stuff so that it will transfer to the medium being printed. The lower the energy level, the easier it is to transfer the ink. However, the lower energy inks may produce printings which are deficient in light and wash fastness. The high energy inks are more difficult to transfer but generally give printed fabrics having outstanding levels of light and wash fastness.

Preferred dyes include dyes manufactured by Ault and Wiborg, Ltd., London, England, including:

Aultran* Red F02
Aultran Red F04
Aultran Blue F56
Aultran Blue F57
Aultran Yellow F23
Aultran Yellow F24
Aultran Violet F62
Aultran Black F81

*"Aultran" is a trademark of Ault and Wiborg

It is believed that these dye pigments are sublimatable anthroquinone, azo and methine dyestuffs.

SUMMARY OF THE INVENTION

A process is provided for producing an intermittently dyed, textured, synthetic polymeric yarn comprising:

(a) applying to at least one end of at least one package of synthetic polymeric yarn a solution of a sublimatable dye pigment, (b) drying the dyed yarn package, (c) withdrawing at least one end of the yarn from at least one package and directing the yarn end to and around a first rotating predraw roller and thence to and around a second rotating, heated draw roller rotating at a faster peripheral speed than the first roller to impart draw to the yarn, (d) feeding the dyed and drawn yarn to and through a texturizer, and (e) accumulating the dyed, drawn and texturized yarn on a takeup device.

A multiplicity of yarn packages can be employed to produce a multiple ply, intermittently dyed, drawn and texturized yarn.

In a preferred process, the multiple feed yarn packages have different diameters, thereby producing a multiple-ply, highly random, intermittently dyed, drawn and texturized yarn.

The synthetic yarn utilized in the process of this invention is selected from the class consisting of polyester, polyamide, cellulose acetate, polyvinyl chloride, and polypropylene yarns, and polyester is preferred.

Also provided is a process for producing an intermittently dyed synthetic polymeric yarn comprising applying to at least one end of a synthetic polymeric yarn package a solution of a sublimatable dye pigment and thereafter drying the dyed yarn and applying heat to the yarn to fix the dye thereto.

The products produced by the aforesaid processes and fabrics made therefrom are also provided.

Figure 1:
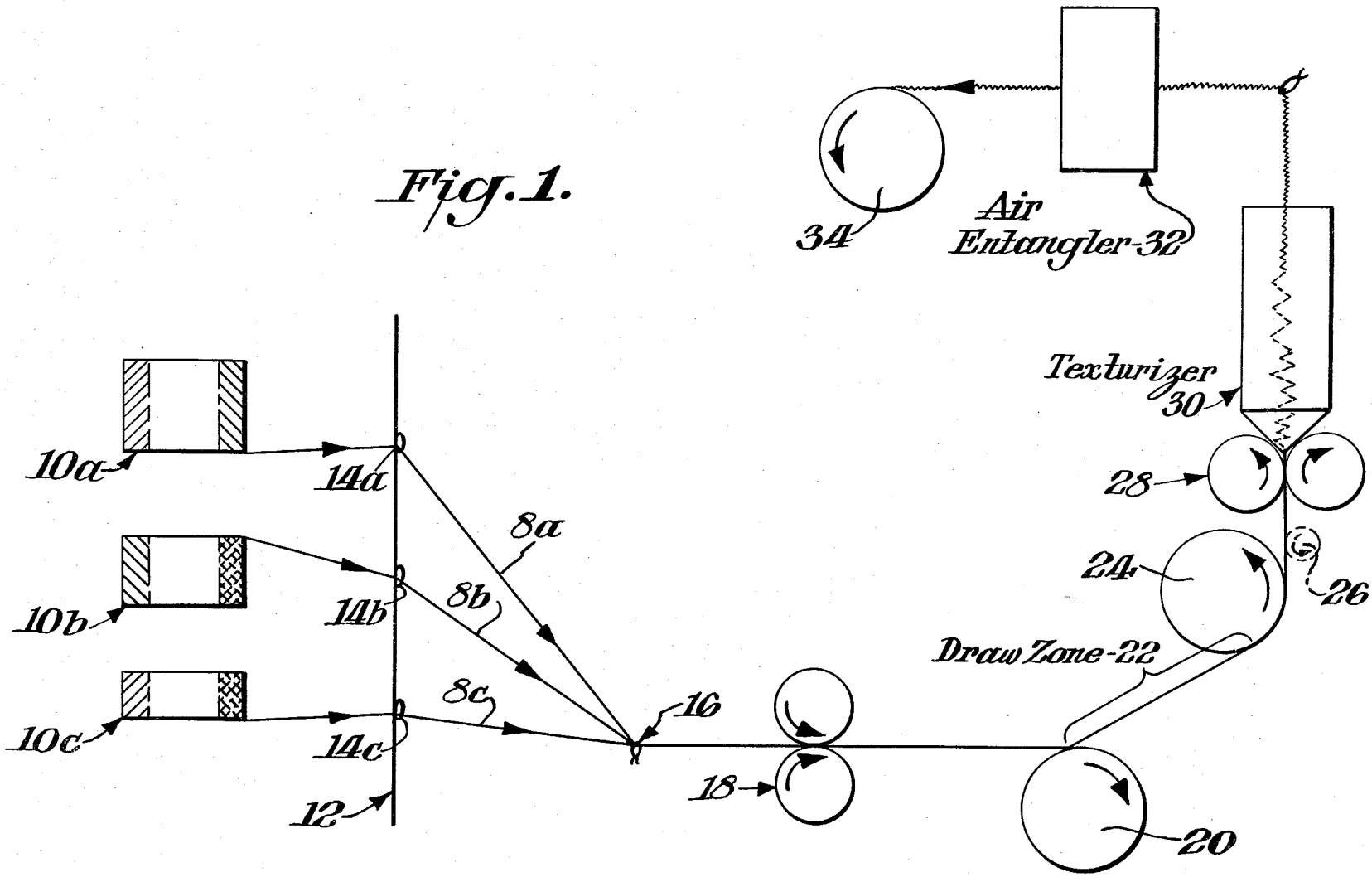
FIG. 1 is a schematic diagram of the apparatus used in carrying out the process of this invention showing the feed yarn packages 1*a, b,* and *c* having different colored ends being fed to temperature-controlled drawing and texturizing apparatus and thence through an entangler and finally to a take-up roll.

DETAILED DESCRIPTION OF THE INVENTION AND PREFERRED EMBODIMENTS WITH REFERENCE TO THE DRAWINGS

A detailed description of the invention is most readily provided by referring to the drawings. The best mode for carrying out the process of this invention is described in detail in the Examples below.

To prepare a yarn package for feeding to the draw/-texturizing apparatus according to this invention, at least one end of the package is immersed in a solution of one of the aforementioned sublimatable inks. Typically, a yarn package will comprise yarn wound upon a two (2) inch diameter core to provide a package about eight (8) inches in diameter and about ten (10) inches in length, although these dimensions can vary considerably. The package can be immersed to any desired depth into the dye solution. Preferably, the dye is dissolved in water. Upon removal from the dye solution, the package is allowed to partially dry, preferably for twenty-four (24) hours, and then placed upon a creel for feeding to the draw/texturizing apparatus.

Partially oriented feed yarn is preferred.

The term "partially oriented" yarn as used herein means yarn which has been drawn from its as-spun undrawn condition to an extent of at least two (2) times its undrawn length. Such yarns are commercially available and sold, for example, by E. I. du Pont de Nemours and Co., Inc., under the product designation DACRON® polyester yarn.* This yarn is partially oriented by the manufacturer by drawing about 3X, i.e. from about 750 denier as-spun to about 250 denier as obtained commercially. While partially oriented yarn is preferred for use in the process of this invention, undrawn or highly drawn yarns may also be utilized.

*"DACRON" is a registered trademark of duPont.

Unoriented, partially oriented and fully oriented synthetic yarns may be space-dyed by the process of this invention and texturized, if desired. Textured yarn is preferred.

FIG. 1 schematically illustrates the passage of feed yarn fed from the pre-treated (dyed) packages through the draw/texturizing apparatus. Three (3) yarn ends 8*a–c* are withdrawn from three (3) pre-treated, dyed yarn packages 10*a–c,* respectively. One end of package 10*a* has been dyed brown, the other green. One end of package 10*b* has been dyed green, the other orange. One end of package 10*c* has been dyed brown, the other orange. These color combinations can be varied as desired. The three yarn ends are passed to creel 12 and through guiding eyelets 14*a–c* and thence through gathering eyelet 16. From eyelet 16, the three ply, three color yarn bundle enters the drawing apparatus which comprises a set of driven rolls 18 feeding the yarn to heated predraw roller 20, the yarn passing around roll 20 a number of times, preferably 7–14 times, in order to thoroughly heat the yarn, and thence through the draw zone 22 to and around heated draw roll 24, the yarn also passing around roll 24 a number of times, preferably 14–21 times, in order to prevent slippage and to maintain the yarn at temperature.

The predraw roll 20 and the draw roll 24 are heated by conventional means, not shown, for convenience. Such heating means can be internal electrical resistance heaters, for example. In processing 250 denier polyester yarn, for example, the predraw roll typically may be 5½ inches in diameter, heated to a temperature of about 200° F., rotating at 375–750 rpm, and has seven wraps of yarn. The draw roller 24 typically may be 5½ inches in diameter, heated to a temperature of about 425° F., rotating at 600–1200 rpm, and has fourteen wraps of yarn. Such conditions would result in a draw ratio of 1.6, i.e. 250 denier yarn would be drawn down to 150 denier yarn.

From the draw roll 24, the drawn yarn is fed to optional oil or finish applicator roll 26, and is driven into heated stuffer box crimping device 30 in order to texturize (crimp) the yarn, and thence through optional air entangler 32 and finally to take-up roll 34. The rotational speed of take-up roll 34 is adjusted relative to the rotational speed of drive rolls 28 to provide a continuous accumulation of yarn in the crimping device 30. The chamber of device 30 is heated, thereby providing additional means for accomplishing heat fixation of the inks to the yarn.

Preferably, the texturizer is of the stuffer box type, although any texturization process involving yarn deformation (crimping) under application of heat could be utilized. False twist texturizing, for example, is also contemplated.

Figure 2:
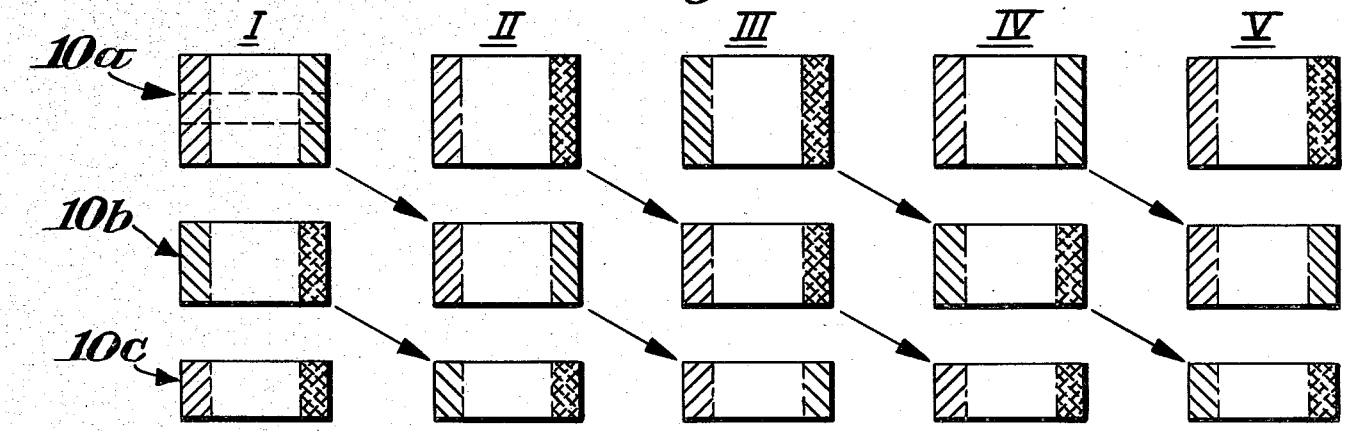
FIG. 2 illustrates the sequence of feed yarn packages to be utilized in producing a 3-ply, 3-color space-dyed yarn which can be woven or knitted into a fabric having a very highly random pattern of color.
Figure 3:
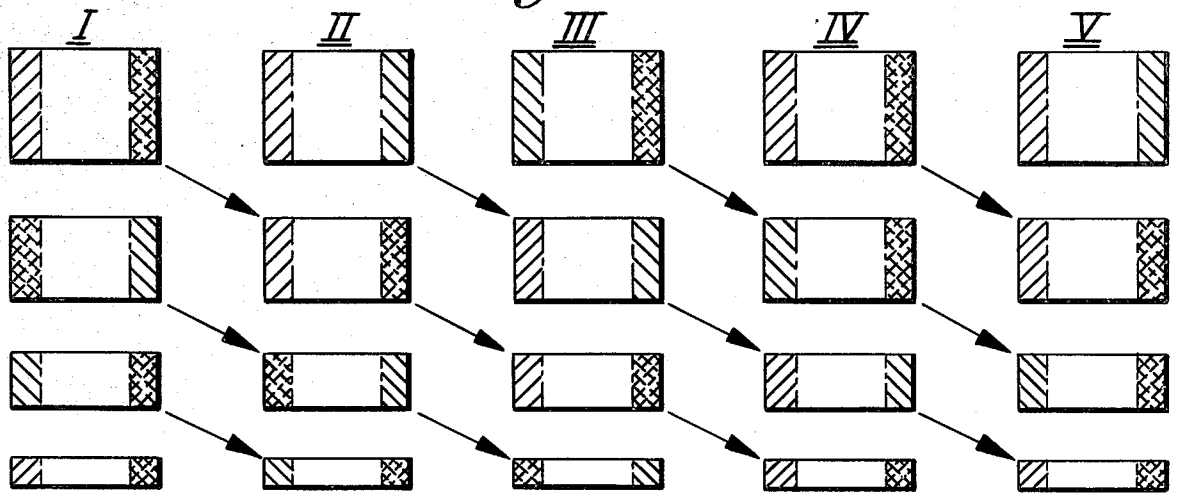
FIG. 3 illustrates the sequence of feed yarn packages to be utilized in producing a 4-ply, 3-color space-dyed yarn which can be woven or knitted into a fabric having a very highly random color pattern.

FIG. 2 and FIG. 3 illustrate various combinations of feed yarn packages which may be used to produce multi-colored space-dyed yarn which can be woven or knitted into fabrics having extremely highly random color patterns.

In FIG. 2, column I indicates the same yarn package combination shown in FIG. 1 described previously. Package 10*a* is larger in diameter than 10*b* which, in turn, is larger than package 10*c*. Typically, package 10*a* will be eight (8) inches in diameter, 10*b* will be six (6) inches in diameter and 10*a* will be four (4) inches in diameter. The inner core present in all packages is shown dotted in package 10*a* in FIG. 2. A large diameter package that is impregnated with ink at one end thereof will yield, on unwinding, relatively long sections of dyed yarn with relatively long sections of undyed yarn between the colored sections. A small diameter package, on the other hand, will yield shorter dyed lengths and shorter undyed lengths at higher frequency than the larger tube.

When multiple yarn packages of different diameters are used in the process of this invention, a multiple-ply yarn bundle is produced having a highly random combination of dyed-undyed segments in components of the bundle. When such multiple yarn packages having different diameters are also dyed as indicated in FIG. 2 at the respective ends thereof, a yarn bundle having a tremendously complex, random space-dyed color combination is achieved which, when woven or knitted into a fabric, produces a heretofore unachievable, highly random color pattern.

FIG. 2 specifically shows the feed yarn packages for making a 3-ply, 3-color product. The packages 10*a–c* in column I represent the initial load on the creel impregnated at the ends with three (3) different colors as shown in FIG. 1. As yarn is withdrawn from the feed packages, all three tubes become smaller to the point where the smallest package 10*c* at the start is exhausted and must be replaced. During this time period, the largest package 10*a* and intermediate package 10*b* are reduced to smaller sizes as indicated by the arrows in FIG. 2, extending from column I to column II. At the point in time when the smallest package is exhausted, a large package having the same color sequence as the exhausted package is placed in the system and operation is continued. As the smallest tubes progressively become exhausted, they are replaced by large tubes as indicated by the arrows and columns III, IV and V. It can be seen that, as operation progresses, the feed column represented by column IV of FIG. 2 is identical with column I and the process is cyclical.

Variations in overall color effects exist within the yarn produced from packages in any individual column and between yarns produced from different columnar arrangements, but these variations are generally slight and tend to be masked by the complexity of the color pattern. The variations substantially disappear when a large number of the yarns are utilized in making a multiple-end product such as in warp knitting. Also, if a 6-ply yarn is produced, a feed system represented by a combination of columns I and II of FIG. 2 will yield a product having a greater degree of randomness in its color pattern having less variations in overall color effects.

FIG. 3 illustrates a system of yarn feed packages to be used to produce a 4-ply, 3-color yarn. FIG. 3 is similar to FIG. 2. It is to be noted that in this system, once the smallest package in column III is exhausted the feed system of column I is repeated.

Figure 4:
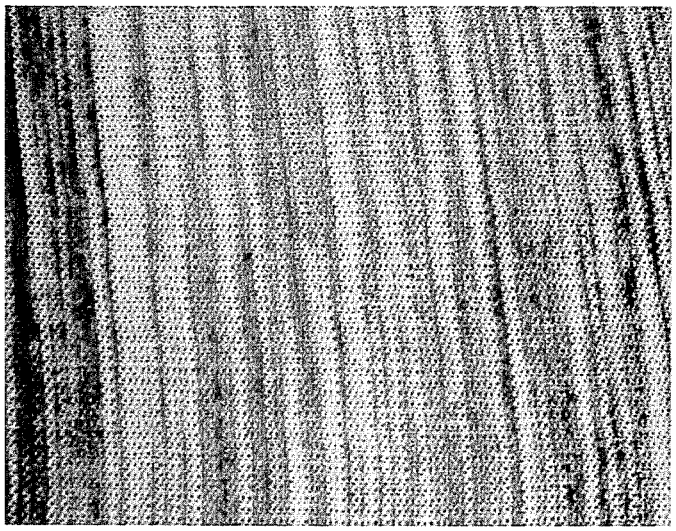
FIGS. 4 and 5 are photographs of a knitted fabric produced from 3-ply, 1-color yarn made as shown in FIG. 1. The random nature of the color patterns is evident in these photographs.

FIG. 4 is a photograph of a fabric knitted from a 3-ply, 1-color yarn produced according to the process shown in FIG. 1 and described hereinabove. The highly random nature of the color pattern in this fabric is evident.

Figure 5:
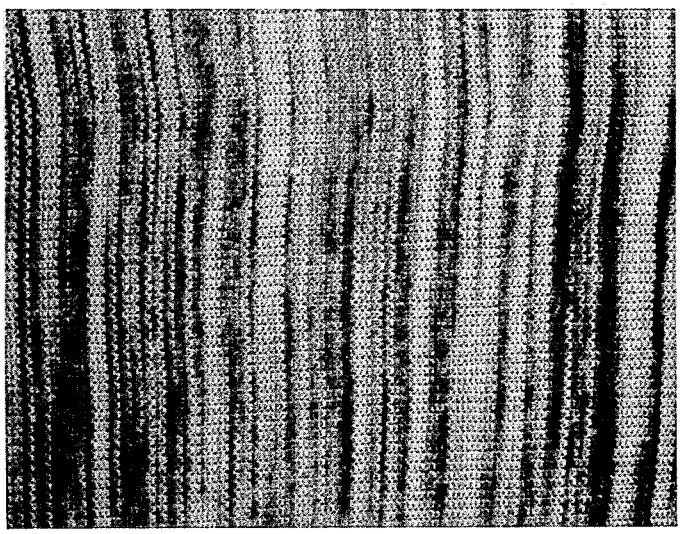

FIG. 5 is a second photograph of the fabric shown in FIG. 4 taken at a different location.

In summary, a process is provided for space dyeing synthetic yarn in which the synthetic yarn, such as polyester yarn, wound upon a yarn package, is first dyed by immersing the ends of the package into a solution of at least one sublimatable ink, thereby dyeing the yarn located at the ends of the package but leaving the yarn at the center of the package undyed, and then at least two ends from at least two such packages are passed through otherwise conventional drawing and texturizing apparatus. Each yarn so fed is intermittently dyed and undyed along its length, the color strength near the dye boundaries being attenuated and muted due to sublimation of the inks and diffusion and migration of the dyes through the yarn ends and into the package. By utilizing at least two feed yarn packages in such process having significantly different diameters and different colored ends thereof, very highly random dyeing effects are achieved in a knitted or woven fabric product produced from such yarns. Also provided are new space-dyed yarns produced by the aforesaid process and fabrics produced from such yarns.

The synthetic yarns suitable for use in this process include the yarns obtained by spinning or extrusion of polymers, copolymers, graft copolymers and mixtures thereof, including polyesters, polyamides, cellulose acetate, polyvinyl chloride, polypropylene and similar thermoplastic polymers. The process is especially suited for continuous dyeing, drawing and texturizing polyester yarns.

While the invention has been described above and in the examples which follow in connection with certain specific details and embodiments, it will be clear to one skilled in the art that changes or modifications deviating from these specific embodiments may be made without deviating from the gist of this invention, and such changes and modifications are deemed to fall within the scope of the claims below.

The examples which follow are intended to be illustrative of the process of this invention, but not to limit the scope of the invention in any way.

EXAMPLE 1

Three feed yarn packages having diameters of 8, 6, and 4 inches, respectively, were prepared for feeding to the drawing and texturizing apparatus shown in FIG. 1 as follows. Each end of each feed yarn package was immersed to a depth of two (2) inches in a dye solution comprising 10% by weight in water of a black, sublimatable ink pigment (product designation Black F81, produced by Ault and Wiborg, Ltd., London, England). The packages were immersed in the dye solution for 30 minutes and were then removed from the bath and drained and allowed to dry in ambient air for 24 hours.

The yarn used in this example was supplied by E. I. duPont de Nemours and Co., Inc., and was partially oriented polyester yarn available commercially under the designation "DACRON" polyester yarn, 250/34, Type 242T.

The three (3) pretreated yarn packages were then placed on a supply creel, and one end from each package was fed to and through a gathering eyelet, thereby gathering the yarn into a three-ply single bundle, and this yarn was then passed through conventional drawing and texturizing apparatus as shown in FIG. 1. The yarn was so processed at a rate of 600 yards/minute fed to a FDJCH Model crimping machine (manufactured by Techniservice Corporation, Kennett Square, Pennsylvania). The draw ratio employed was 1.67 and only the draw roll was internally heated, in this example to 400° F. The crimping chamber walls were maintained at 325° F. From the crimper, the yarn passed through a conventional air entangling device and thence to a takeup roll.

A highly randomly dyed 3-ply, 1-color yarn was thus produced which, when knitted into a fabric, produced a highly random color pattern similar to that shown in the photographs of FIGS. 4 and 5.

EXAMPLE 2

For this example, four (4) yarn packages of varying diameters were employed similar to the diagram shown in FIG. 3. The yarn was duPont partially oriented "DACRON" polyester, 250/34, Type 242T. The diameters of these packages initially were 8, 6, 4 and 3 inches, respectively. Each package was immersed to a depth of two (2) inches into ink solutions of the compositions shown in the table below to form the supply system shown in Column I of FIG. 3:

| Dye* | Solution A, wt % based upon total wt of dye | Solution B, wt % based upon total wt of dye | Solution C, wt % based upon total wt of dye |
|---|---|---|---|
| Yellow "F23" | 35% | 35% | 50% |
| Red "F02" | 50% | 0% | 45% |
| Blue "F56" | 15% | 55% | 5% |
| Black "F81" | 0% | 10% | 0% |
| Total ink concentration, wt % based upon total wt of solution | 7% | 8% | 8% |

*Available commercially from Ault and Wiborg, Ltd., London, England.

Each package was dyed, drained and allowed to dry for a period of 24 hours. These packages were then mounted on a creel as shown in FIG. 1 and the ends of each were gathered into a bundle through an eyelet and the bundle was passed to the predraw roller which was a roller of 5.5 inch diameter maintained at 70° C., the bundle passing 14 times around the predraw roller and thence passing to the draw roller maintained at 225° C. and passing 21 times around the draw roller, which imparted a draw of 1.67 X on the yarn bundle.

From the draw roller, the yarn was passed into and through Model M-600 Stuffer box crimping device (Techniservice Corporation). The yarn entered the crimper at a rate of 650 yards per minute. The walls of the accumulation chamber in the crimping device were maintained at 150° C. Upon exit from the crimper, the yarn passed through an air entangler and thence was wound upon a takeup roll.

The product yarn possessed highly random intermittent dyed and undyed sections. At points along the length of the yarn, one of the three principal colors was reinforced where two contiguous strands dyed that color happened to end up adjacent one another in the final product. At other points, there was a blending of two or all three of the colors, and at other points where dyed lengths were succeeded by undyed lengths, there was a gradual change from color to white. The color strength near the dye boundaries was attenuated and muted.

A fabric was knitted using the product yarn so produced, and wash fastness tests were conducted. These tests yielded a 4 to 4.5 rating for an AATCC II-A cycle test and a 3.5 to 4 rating for an AATCC III-A wash cycle test. Thus, the fabric is suitable for upholstery and drapery applications and for some apparel uses.

EXAMPLE 3

Three yarn packages of duPont partially oriented "DACRON" polyester yarn, 250/34, Type 242T each were impregnated at both ends by immersion to a depth of two (2) inches for 10 minutes in an aqueous solution of 3.3% by weight (based upon total solution weight) of "BLUE FW 59/1" sublimatable dye pigment (Ault and Wiborg, Ltd.). The diameters of the yarn packages were 8, 6 and 4 inches, respectively. The impregnated packages were drained and air dried for 24 hours and then drawn and texturized as in Example 2 except that in this example an FCJ Model stuffer box crimper (manufactured by Techniservice Corporation) was employed. This crimping device is suitable for fine yarns but is not as closely temperature controlled as the Model M-600 crimper.

Yarn produced according to this example was knitted into a fabric and a highly random distribution of color patterns similar to that shown in FIG. 4 was achieved. This fabric was subjected to wash fastness tests as in Example 2. These tests yielded a rating 3.5 to 4 in an AATCC II-A wash test and a rating of 3.0 to 3.5 in an AATCC III-A wash test. The product is, therefore, suitable for upholstery and drapery uses.

What we claim is:

1. A process for producing an intermittently dyed, textured synthetic polymeric yarn wherein a multiplicity of feed yarn packages having varying diameters is employed to produce a multiple ply product yarn, which process comprises:

(a) applying to at least one end of at least two of said feed yarn packages a dispersion of a sublimatable dye pigment, (b) drying the dyed yarn packages, (c) withdrawing feed yarn from each of said feed yarn packages having varying diameters and directing said yarn ends to and around a first rotating predraw roller and thence to and around a second, rotating draw roller rotating at a faster, peripheral speed than said first roller to impart draw to said yarns, (d) feeding said dyed and drawn yarns to and through a texturizer, and (e) accumulating said dyed, drawn and texturized yarn on a takeup device.

2. The process of claim 1 wherein one color dye is applied to one end of one of said yarn packages and another, different color dye is applied to the other end of said yarn package.

3. The process of claim 1 wherein the same color dye is applied to both ends of one of said yarn packages.

4. The process of claim 1 in which said synthetic yarn is selected from the class consisting of polyester, polyamide, cellulose acetate, polyvinyl chloride, and polypropylene yarns.

5. The process of claim 4 in which said synthetic yarn is partially oriented polyester yarn.

* * * * *